US005315944A

United States Patent [19]

Reinders

[11] Patent Number: 5,315,944

[45] Date of Patent: May 31, 1994

[54] MACHINE FOR AUTOMATICALLY CHANGING LOWER-THREAD BOBBINS

[75] Inventor: Peter Reinders, Ochtrup, Fed. Rep. of Germany

[73] Assignee: Carl Schmale GmbH, Ochtrup, Fed. Rep. of Germany

[21] Appl. No.: 66,626

[22] Filed: May 25, 1993

Related U.S. Application Data

[63] Continuation of Ser. No. 777,561, Dec. 8, 1991, abandoned.

[30] Foreign Application Priority Data

Jun. 22, 1989 [DE] Fed. Rep. of Germany ..... 3920461
Jun. 22, 1989 [DE] Fed. Rep. of Germany ..... 3943467

[51] Int. Cl.[5] ..... D05B 57/26
[52] U.S. Cl. ..... 112/180
[58] Field of Search ..... 112/180, 181, 185, 186, 112/279, 285; 242/20, 35.5

[56] References Cited

U.S. PATENT DOCUMENTS 2,438,459 3/1948 Sebell .
2,690,725 10/1954 Schumann et al. .
2,733,676 2/1956 Schumann et al. .
3,376,838 6/1968 Schiffmacher et al. .
3,981,256 9/1976 Sexton .
5,143,004 9/1992 Mardix ..... 112/186

FOREIGN PATENT DOCUMENTS 61-172589 4/1986 Japan .

OTHER PUBLICATIONS

Japanese Patents Gazette, Section Ch: Chemical, Derwent Publications Ltd., 1986, pp. 7–8.

*Primary Examiner*—Clifford D. Crowder
*Assistant Examiner*—Paul C. Lewis
*Attorney, Agent, or Firm*—Herbert Dubno

[57] ABSTRACT

An automatic bobbin-winding machine, in particular for lockstitch machines, comprises a changing head (27) with pneumatically driven gripping levers (30,31) for removing the lower part (35) of the bobbin case holder from the sewing machine. The changing head (27) can pivot or oscillate about various axes (39,40,41) and move on a carriage (26). It cooperates with a magazine (22) arranged alongside the axis (39). A second changing head (27') which can pick up empty and full bobbins (2) alternately may also be arranged on the carriage (26).

2 Claims, 2 Drawing Sheets

MACHINE FOR AUTOMATICALLY CHANGING LOWER-THREAD BOBBINS

This is a continuation of co-pending application Ser. No. 07/777,561 filed on Dec. 8, 1991, now abandoned.

CROSS REFERENCE TO RELATED APPLICATIONS

This is a National Phase application of PCT/DE 90/00468 filed Jun. 20, 1990 and based in turn upon German national applications P39 20 461.8 and P39 43 467.2 of Jun. 22, 1989 under the International Convention.

FIELD OF THE INVENTION

The invention relates to a machine for automatically changing lower-thread bobbins, particularly for lockstitch sewing machines, with a device actuatable by pneumatic cylinders for the pickup of an empty bobbin from a bottom part of a bobbin case of the sewing machine, for the pickup of a full bobbin from a magazine and for the transfer of this full bobbin into the sewing machine, whereby the pneumatic cylinders actuate gripping levers and a carriage can be displaced longitudinally and can be rotated.

BACKGROUND OF THE INVENTION

In the course of automation in the field of sewing installations, automatic winding means have been developed which perform an automatic winding of lower-thread bobbins in sewing machines. However, in order to be efficient the automatic winding of bobbins requires also an automatic bobbin exchange.

Such an automatic bobbin exchange is described in U.S. Pat. No. 3 376 838. This purpose is served by a pneumatically swingable and electromagnetically displaceable gripper lever for the pickup of the bobbin from the bobbin case carrier of the sewing machine, while a carriage-like bobbin carrier can travel back and forth between the magazine and the sewing station.

A control unit monitors the timing of the operation of individual components. The device is comparatively obstructing and projects very far laterally, so that it is difficult to mount on the sewing machine.

U.S. Pat. No. 2 690 725 also shows an automatic bobbin changer, wherein a control shaft travelling back and forth is actuated by a pneumatic cylinder and has at its end a gripper claw carrier. The latter is pivotable about the axis of the control shaft and is provided with receiving devices for the pickup of the bobbins.

The transfer of the full or the empty bobbins takes place due to the rotation of the gripper claw carrier. The device has numerous complicated components and is expensive.

OBJECT OF THE INVENTION

It is the object of the invention to provide a machine for the automatic changing of lower-thread bobbins, which can be used in high-speed industrial sewing machines and is characterized by a high degree of reliability, compact construction and simple assembly.

SUMMARY OF THE INVENTION

The machine for automatically changing lower-thread bobbins, particularly for lockstitch sewing machines, can comprise, according to the invention, a device actuatable by pneumatic cylinders for the pickup of empty bobbins from the bottom part of a bobbin case of the sewing machine, for the pickup of a full bobbin from a magazine and for the transfer of this full bobbin into the sewing machine. The pneumatic cylinder actuates carriages upon which gripper levers, or a bobbin carrier, are mounted and which can be transversely displaced on these carriages.

According to the invention, on the carriage a changing head is mounted which can be displaced laterally outwardly with respect to the sewing machine in the axial direction.

The changing head can be swung on the carriage in the axial direction into a rotation axis which is perpendicular to the axis of the gripper of the sewing machine.

The changing head has a recess with an elastic shaft projection for the bottom part of the bobbin case carrier and two two-armed gripping levers cooperating with the bottom part of the bobbin case carrier and actuatable by the pneumatic cylinders.

The gripper levers are loaded by springs which cause the opening of the gripping levers, while the closing of the gripper levers is effectuated by the pneumatic cylinders.

The gripper levers can be selectively actuated, either separately or together.

One gripper lever can be equipped at one of its free ends with a device designed as a latch for the release of the connection between the two parts of the bobbin case carrier.

The rotation of the changing head about the rotation axis can be pneumatically produced.

The changing head can be tiltable about a horizontal axis.

With the machine of the invention it is possible to achieve even in high-speed industrial sewing machines the automatic replacement of empty lower-thread bobbins with full bobbins.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
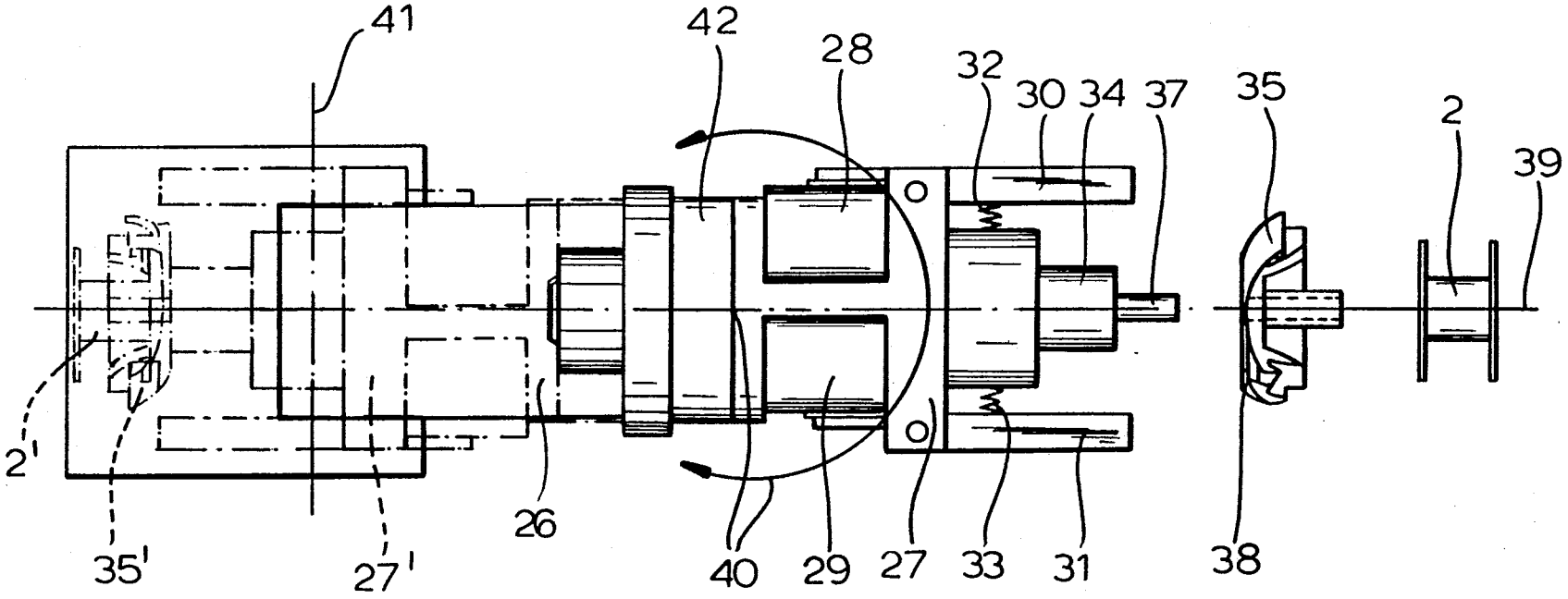
FIG. 1 is a top view of the changing head of the machine.

FIG. 1 shows a top view of the changing head 27, which represents the most essential part. The changing head 27 works together with a bobbin magazine 22 (FIG. 2), by extracting therefrom the full bobbins 2 and then, after a pneumatically generated rotation about a vertical rotational axis 40 of the changing head 27, swinging its longitudinal axis 39 into line with the axis of the gripping device (bobbin case carrier) of the sewing machine and inserting the full bobbin 2 with the bottom part of the bobbin case carrier 35.

The same process in reverse takes place when an empty bobbin is taken out of the sewing machine. The changing head 27 is laterally outwardly displaceable on a carriage 26, i.e. it can travel away from the sewing machine along the axis 39.

The changing head 27 consists of two pneumatic cylinders 28, 29 each acting on one of two two-armed gripper levers 30, 31. The gripper levers 30, 31 are loaded by springs 32, 33 which cause the opening of the gripper levers 30, 31, while the pneumatic cylinders 28, 29 serve for the closing of the gripper levers 30, 31.

The changing head 27 has a boss forming a receiver 34 for the bobbin case carrier 35. On this receiver 34, an elastic shaft projection 37 is arranged.

By correspondingly operating the pneumatic cylinders 28, 29, the two-armed gripper levers 30, 31 can be selectively actuated, either separately or together. By actuating only the right gripper lever 31, the connection (e.g. a latch 38) between the two parts usually composing the bobbin case carrier is released, so that the bottom part of the bobbin case carrier 35 with the bobbin 2 can be taken out of the sewing machine.

The changing head 27 can be tiltable about a horizontal axis 41. On the carriage 26, a second changing head 27' (shown in dot-dash lines) can be provided along the longitudinal axis 39 or at an angle thereto, which makes possible the insertion of a bobbin case carrier 35' with a full bobbin 2', while the first changing head 27 swings out with an empty bobbin in the bottom part of the bobbin case carrier 35.

The changing head 27 is further rotatable about its longitudinal axis 39 by means of a pneumatic adjusting cylinder 42, in order to be able to insert the thread of bobbin 2 into the bottom part of the bobbin case carrier 35.

Figure 2:
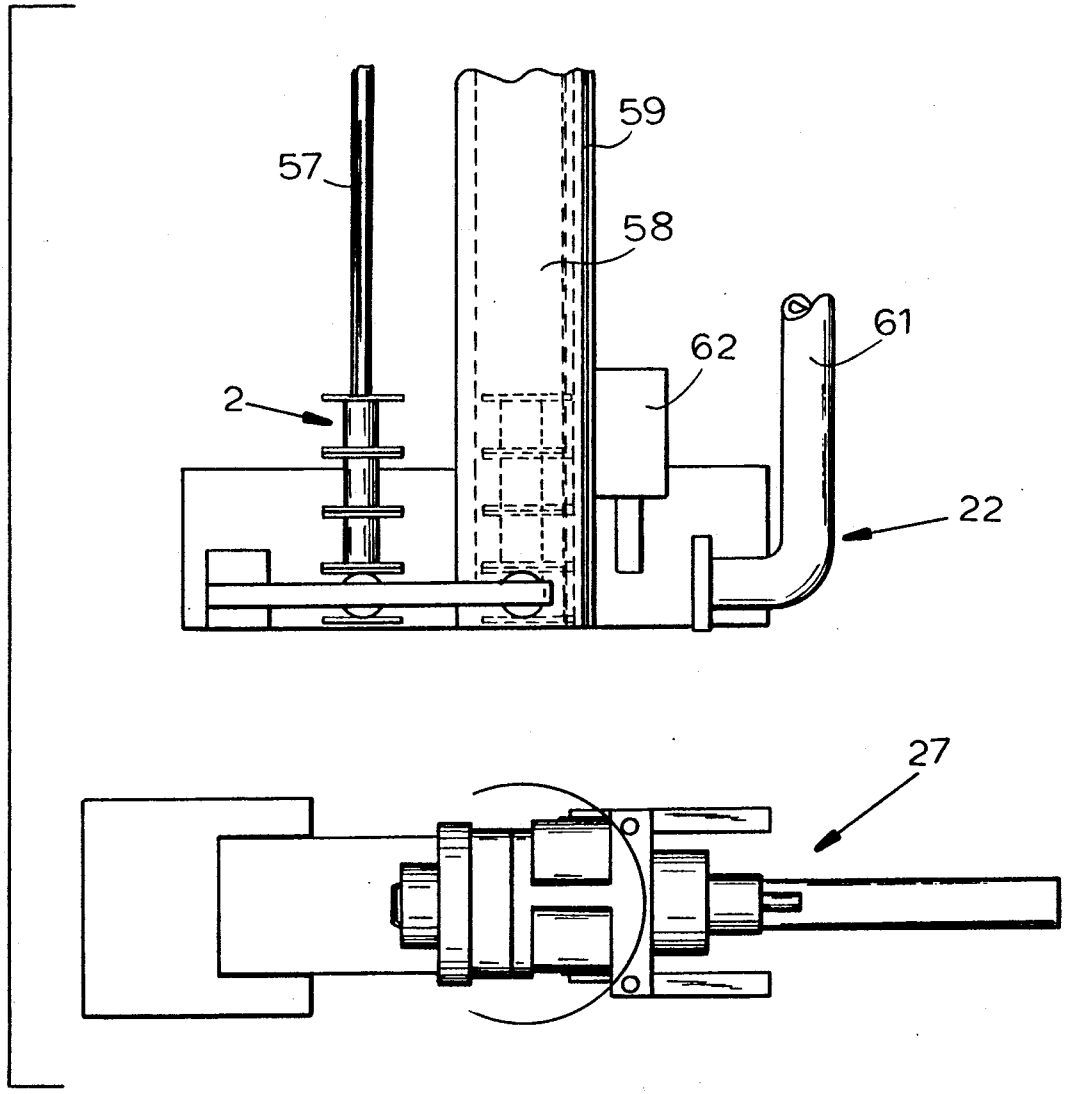
FIG. 2 is a schematic view of additional mechanisms on the magazine.

FIG. 2 shows a schematic representation of additional mechanisms on the magazine. Upon pivoting about its vertical axis 40 through 90°, the changing head 27 transfers the empty bobbin 2 to a magazine rod 57, after which the changing head 27 is shifted toward the side 58 for full bobbins 2 of the magazine 22 along axis 39 in order to pick up a full bobbin. Laterally on this magazine a suction nozzle 61 is mounted, which draws out the thread hanging out of the slot 59. Between the magazine 22 and the suction nozzle 61 a tongue is provided, which is pneumatically actuatable and which stresses the thread so that it is automatically threaded into the sewing machine when the changing head 27 swings through 90°. After that, the pneumatic tongue releases the thread, and the changing head 27 advances along axis 39 to insert the full bobbin 2 into the sewing machine after the turn of 90°.

I claim:

1. A bobbin changer for a sewing machine having a lower bobbin and a case cover for said bobbin, said bobbin changer comprising:

first elongated magazine means for storing a plurality of depleted bobbins to be rewound;

second elongated magazine means adjacent said first magazine means and parallel thereto for holding in alignment a plurality of full bobbins;

a carriage movable along a longitudinal axis perpendicular to said first and second magazine means and parallel to an axis of a bobbin and case cover of the sewing machine;

a changing head of said carriage aligned with said bobbin and said case cover in an initial position of said changing head on said carriage;

actuating means for rotating said changing head about a rotation axis perpendicular to said longitudinal axis, thereby swinging said changing head into an orientation at a right angle to said longitudinal axis for alignment with said first magazine means in a first loading position, said carriage being shiftable along said orientation with said second magazine means in a second loading position;

said changing head being provided with a boss formed with an elastic projection receiving said case cover and a depleted bobbin from said sewing machine in said initial position, gripping arms each in the form of a double arm lever, means including two pneumatic cylinders respectively connected with said levers for selectively operating same, said levers engaging said case cover in said initial position, whereby said depleted bobbin is inserted into said first magazine means in said first loading position and a full bobbin is picked up by said changing head in said loading position.

2. The bobbin changer defined in claim 1 wherein said changing head has a respective spring engaging each of said double-arm levers.

* * * * *